United States Patent [19]

Doi

[11] 4,110,573

[45] Aug. 29, 1978

[54] SNAP ACTION SWITCH

[75] Inventor: Scott S. Doi, Sidney, N.Y.

[73] Assignee: The Bendix Corporation, Southfield, Mich.

[21] Appl. No.: 718,500

[22] Filed: Aug. 30, 1976

[51] Int. Cl.[2] ..... H01H 5/22

[52] U.S. Cl. ..... 200/67 DA; 200/67 E; 200/249

[58] Field of Search ..... 200/67 D, 67 DA, 67 DB, 200/67 E, 67 PK, 249, 251, 286, 835, 153 V

[56] References Cited

U.S. PATENT DOCUMENTS

| | | | |
|---|---|---|---|
| 2,603,727 | 7/1952 | Auer | 200/67 D |
| 2,927,171 | 3/1960 | Rhodes | 200/67 D |
| 3,248,959 | 5/1966 | Angold | 200/67 D |
| 3,335,240 | 8/1967 | Dhaens et al. | 200/67 DA |

*Primary Examiner*—Samuel W. Engle
*Assistant Examiner*—Ralph Palo
*Attorney, Agent, or Firm*—Kenneth A. Seaman; Raymond J. Eifler

[57] ABSTRACT

An improved snap action switch wherein a snap action blade (30), that moves a contact carrying leaf spring (40), includes a latch (31) that mates with a notch (41) in the leaf spring member to eliminate the "teasing" effect normally associated with opening and closing a snap action switch.

10 Claims, 4 Drawing Figures

FIG. 2
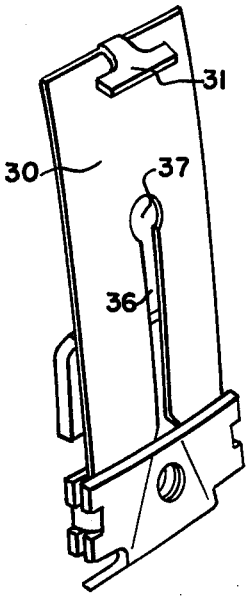
FIG. 3
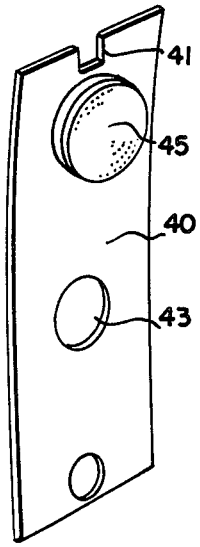
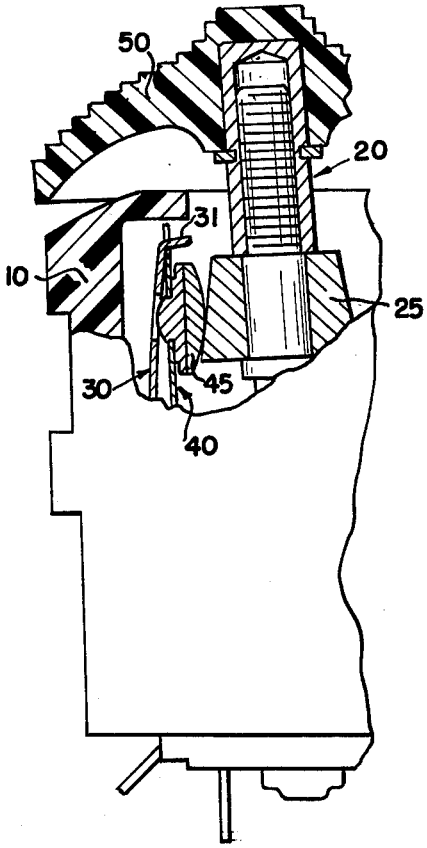
FIG. 4

SNAP ACTION SWITCH

BACKGROUND OF THE INVENTION

This invention relates to a snap action switch. The invention is more particularly related to an improved snap action assembly within the switch that minimizes the failure rate of the snap action switch due to the minimizing of stresses within a metallic member that previously caused breaking or failure of the switch.

Snap action switches, though simple in construction, possess excellent performance characteristics. Examples of such switches are disclosed in U.S. Pat. No. 2,805,297 entitled "Snap Switch Mechanism" issued on Sept. 3, 1957 to G. J. Campbell and U.S. Pat. No. 3,335,240 entitled "Snap Action Switch Device With Improved Circuit Breaker Mechanism", issued Aug. 8, 1967 to E. Dhaens et al. Snap switches of this general type have been employed in a wide variety of circuit control applications. The switches normally include a leaf spring blade provided with a longitudinal slot which extends from one end of the point short of the other end. Bifurcated arms, defined by the slot, are drawn together to stress the blade for snap action. With one end of such blade fixedly mounted, the free extending end normally rests in stable equilibrium at a selected off-center position. By applying pressure at an appropriate point on the blade, near the slot, the free end of the blade may be made to snap from the previously stable position to a new position.

In a simple single-pole, normally open snap action switch, it has been a conventional practice to affix one contact to a snap action blade. Another contact, engageable with the first contact, is located in a shaft so that when pressure is applied to the stressed blade, it snaps the two contacts together under substantial pressure to close an electrical circuit. The snap-action is normally accompanied by an audible "click" which serves to notify the operator of the switch that circuit closure has been accomplished.

When the applied pressure is removed, the stressed blade snaps to its original stable position. The snapping action is accompanied by considerable hysteresis — that is, once sufficient pressure has been applied to cause the blade to be snapped out of its normal stable position, considerably less pressure is required to hold the blade in the new position. As pressure is slowly released, the extended end of the blade may move slightly and open the contacts before the blade makes the return of the original position. This effect, termed "switch teasing" constitutes a serious disadvantage in many applications. Because of this teasing effect, partial release of applied pressure due to inadvertence may open the circuit without causing the switch to snap back to its original position. Misled by the absence of a return "click" the operator may well believe that a circuit continues to be energized. When snap switches are used in a critical application, such as aviation control circuits, the failure to provide positive notification of a circuit opening constitutes a particularly serious disadvantage. In addition, the gap width between the contacts of a teased switch may be quite small. This condition may cause serious arcing across the narrow air gap, resulting in damage to the contacting surfaces.

To eliminate the aforementioned problems, snap action switches have been designed wherein one portion of the leaf spring member carrying the electrical contact was folded over so that a snap action blade having its free end would extend into the gap formed by the fold in the leaf spring. The gap was substantially wider than the width of the snap action blade to permit substantial movement of the blade, between the opposing surfaces of the fold which defied the gap, without causing any motion of the contact carrying leaf spring member. This approach eliminated teasing by allowing substantial movement of the snap action blade before the contacts were separated. However, the fold in the leaf spring member, which was comprised of metal (spring steel), was about 180°. This resulted in undue stresses and strains in the metal comprising the curvature in the fold. The stresses and strains within the fold eventually led to failure of the switch or a large amount of unusable leaf spring members when the leaf spring was formed because the folding causes breaking and cracking of the leaf spring member. Similar problems are present when the fold is attempted to be made in the snap action blade which is comprised of spring steel.

SUMMARY OF THE INVENTION

This invention provides an improved grip stick switch or snap action switch that eliminates the need to fold over the leaf spring member carrying the electrical contact thereby minimizing the stresses within the leaf spring normally present in such a fold.

The invention is a snap action switch characterized by a snap action blade 30 that has, extending therefrom, a latch 31 that is adapted to engage a leaf spring member 40 and rapidly deflects an electrical contact 45 mounted on the leaf spring member 40.

In one embodiment of the invention the snap action switch comprises: a housing 10 having an upper portion; a shaft 20 movably mounted within the housing; a first contact 25 mounted on the shaft 20; a snap action blade 30 mounted within the housing generally parallel to the shaft 20, the blade 30 having an upper end that includes a T-shaped latch 31 extending in the direction toward the shaft (preferably 90°); a leaf spring member 40 mounted intermediate of and generally parallel to the shaft 20 and the snap action blade 30, the leaf spring member 40 having an upper end that includes a notch 41 that mates with the T-shaped latch 31 of the blade 30; a second contact 45 mounted on the leaf spring member 40 and adapted to engage the first contact 25; a button 50 mounted at one end of the shaft and adapted to move the shaft 20 in the direction of the leaf spring member 40 and cause engagement of the first 25 and second 45 contacts when the latch engages said leaf spring member 40.

Accordingly, it is an object of this invention to increase the durability and life of a snap action switch by eliminating folds in the metal members of the switch.

It is another object of the present invention to provide a snap action switch that is substantially totally free from the so-called teasing effect.

The objects of the invention are accomplished by a particular configuration of the snap action blade and the contact carrying leaf spring member.

The above and other objects and features of the invention will become apparent from the following detailed description taken in conjunction with the accompanying drawings and claims which form a part of this specification. Further, the use of numerals is intended for the purpose of clarification only and is not intended to limit the specific structure referenced.

BRIEF DESCRIPTION OF THE DRAWINGS

FIG. 2 is a perspective view of a snap action blade.

FIG. 3 is a perspective view of a leaf spring member having an electrical contact thereon.

FIG. 4 is a partial diagrammatic view of a snap action switch with the electrical contacts thereof in the closed position.

Figure 1:
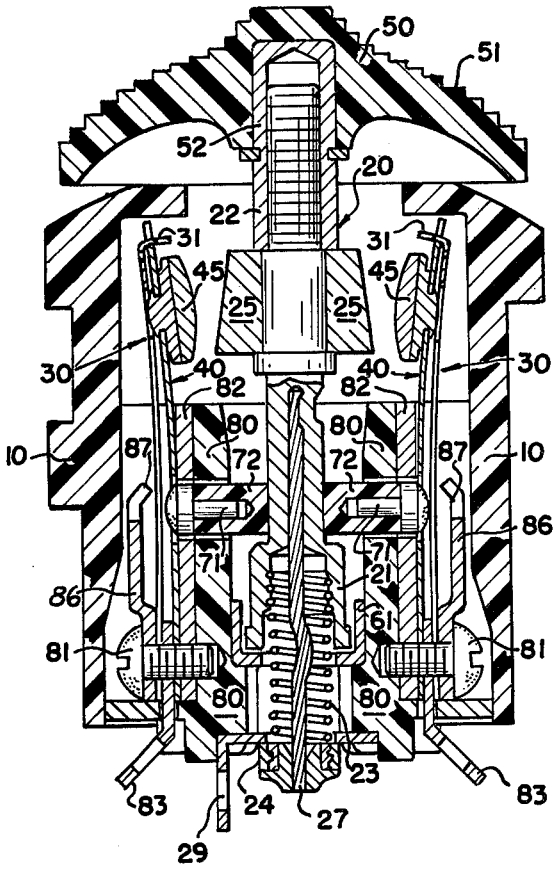
FIG. 1 is a cross-sectional view of a 5-position switch showing in the "open position" one of the four contact assemblies which incorporate the principles of the present invention.

DETAILED DESCRIPTION OF THE DRAWINGS SHOWING THE PREFERRED EMBODIMENT OF THE INVENTION

Referring now to the drawings, FIG. 1 illustrates a multiple position switch for a helicopter commonly known as a "grip stick" switch. The multiple position switch is adapted for operation with the thumb and may be mounted within a hand-gripped switch of the type shown in U.S. Pat. No. 2,747,057 entitled "Switch Mounting Bracket for Airplane Control Stick" issued to T. J. Obszarny on May 22, 1956, or U.S. Pat. No. 3,335,240 entitled "Snap Action Switch Device with Improved Circuit Breaker Mechanism" issued to E. Dahens et al. on Aug. 8, 1967 (hereby specifically incorporated by reference to illustrate the details of the structure of a grip stick switch).

The multiple position switch shown in FIG. 1 includes a cylindrical housing or barrel shape body 10; a first contact 25 mounted on a central shaft 20; a snap action blade 30; a second contact 45 mounted on a leaf spring member 40; and a button 50 mounted to the upper end of the shaft 20. The switch is actuated by lateral movement of the button 50 by the thumb of the pilot's hand. To facilitate movement of the button 50, a plurality of circumferential ridges 51 are provided for the thumb. In this instance, the switch is called a "5-position" switch since it is capable of connecting a conductor to any one of four contacts (not shown) spaced 90° apart (depending upon the direction in which the button 50 is pushed) and the central OFF position which separates the first contact 25 from the remaining contacts 45.

The button 50 includes a metallic threaded liner 52 which engages with the threaded upper end of the shaft 20. A spacer 22, which provides appropriate vertical positioning of the button 50, is threaded onto the shaft 20, above the centrally located electrical contact 25 mounted on the shaft 20. The electrical contact 25 is a square bottomed contact formed in the shape of a truncated pyramid. The shaft 20 passes through and extends downwardly from the contact 25. The lower extremity of the shaft 20 includes an enlarged hollow region 21 having a threaded inner surface. A spring 23 is screwed into and mates with this threaded inner surface. At its lower end, the spring 23 mates with the threaded inner surface of a terminal member 24. A conducting wire 27 is swaged into the central portion of the shaft 20 and is soldered or otherwise bonded to the terminal member 24 at its lower end to provide an electrical connection between the contact 25 and the terminal member 24. A downwardly extending lug 29 on the terminal member 24 provides a convenient point for connection to an external circuit.

The spring 23, which is deformable, permits lateral movement of the shaft 20 and returns button 50 to its central position when a lateral force, applied to the button, is removed. The enlarged region 21 of the shaft 20 engages within and is positioned by a cup 61 having an open bottom through which the spring 23 and conducting wire 27 pass. The enlarged region 21 of the shaft 20 is provided with a rounded bottom which rolls easily in cup 61.

When the button 50 is deflected to the left, the shaft 20 engages with and moves a push rod comprising a metal pin 71 and an insulating sheath 72. The pin 71 passes through an aperture 43 (FIG. 3) in the leaf spring member 40 and bears against a snap action blade 30. The pin 71 and sheath 72 are mounted within an opening in a plastic support member 80. The plastic support member 80 includes a threaded hole which receives a mounting screw 81. The leaf spring member 40 has its lower end portion sandwiched between a metal plate 82 and a lug 83, both of which include drilled holes admitting the shaft of screw 81. The mounting arrangement allows the upper end of the leaf spring member 40 to be resiliently deflectable. The snap action spring blade 30 is sandwiched between the lug 83 and an angular support member 86 which includes a fulcrum point 87 which bears against a central portion of the snap action blade 30. The lug 83 extends downward through an opening in the plastic support member 80 and is flared outward.

FIG. 2 is a perspective view of the snap action blade 30 which interacts with the leaf spring member 40 within the switch to accomplish the objects of the invention. The blade 30 includes a longitudinally extending slot 36, terminating in an aperture 37. The aperture 37 is adapted to receive a portion of the leaf spring contacts 45 when the switch is in the closed position (FIG. 4). The snap action blade 30 which, as shown in FIG. 1, has its lower end mounted within the housing 100, has its upper end terminating in a latch e.g., a T-shaped end portion that is bent about 90° away from the snap action blade. As can be seen in FIG. 1, the T-shaped end portion is mounted within the switch so that it extends in the direction toward the shaft 20. The T-shaped end portion 30 is comprised of a first leg of about 0.085 inches which extends away from the one side of the blade and a second and a third leg which are transverse to the first leg.

FIG. 3 illustrates the leaf spring member 40 which, as shown in FIG. 1, has one end thereof mounted within the housing 10 of the switch assembly. The leaf spring member 40 includes a hole or aperture 43 through which the head of pin 71 (FIG. 1) partially extends; an electrical contact 45; and a notch 41. The leaf spring member is comprised of an electrically conducting material, as is the electrical contact 45. Therefore, when electrical contact 45 engages electrical contact 25 (FIG. 1), an electrical circuit is completed from electrically conducting wire 27 to electrical terminal 83.

As can be seen in FIG. 1, the notch 41 is adapted to receive the stem or first leg of the T-shaped portion 31 extending from the snap action blade. This arrangement captivates the upper end of the spring leaf member 40 between one side of the snap action blade and the second and third legs of the T-shaped portion 31 of the blade 30. The lost motion gap between the blade 30 and the second and third legs of the T-shaped portion permit the blade 30 to move a predetermined distance before contacting the leaf spring 40 and causing the leaf spring 40 to snap.

FIG. 4 illustrates diagrammatically a portion of the snap action switch with the thumb button moved laterally into a position that engages the electrical contact 25 on the shaft 20 with the electrical contact 45 on the leaf spring member 40.

When the contact assembly contemplated by the invention is in an open position, as shown in FIG. 1 of the drawings, the T-shaped portion 31 bears against and flexes the leaf spring member 40 and contact 45 away from the central contact 25. The leaf spring member 40 is under spring tension which tends to move the contact 45 toward the central contact 25 but, in the open position, it is restrained from such movement by the T-portion 31 of the snap action blade 30. When the button 50 is deflected to the left, as shown in FIGS. 1 and 4 of the drawings, the shaft 20 bears against the insulated sheath 72 and the pin 71 bears against the spring tension blade 30 in the neighborhood of the slot 36. When the pin 71 supplies sufficient pressure to the spring blade 30, its upper end abruptly snaps toward the central contact 25. The blade 30 then bears against the leaf spring member 40 moving the contact 45 into engagement with the central contact 25. It should be noted that the contact 25 also moves toward the contact 45. As pressure is slowly released from the button 50 allowing the contact member 25 to move toward its former central location, the spring tension of mounting member 30 causes the contact 45 to maintain engagement with the contact 25 until the blade 30 makes a return snap to its initial stable position.

While a preferred embodiment of the invention has been disclosed, it will be apparent to those skilled in the art that changes may be made to the invention as set forth in the appended claims and, in some instances, certain features of the invention may be used to advantage without corresponding use of other features. For example, although in the preferred embodiment the snap action blade includes the T-shaped end portion and the leaf spring member includes a notch, such arrangement can be reversed. Accordingly, it is intended that the illustrative and descriptive materials herein be used to illustrate the principles of the invention and not to limit the scope thereof.

Having described the invention, what is claimed is:

1. A snap action switch comprising:

a housing having an upper end;

a shaft movably mounted within the housing;

a first contact mounted on said shaft;

a snap action blade mounted within said housing generally parallel to said shaft, said blade having an upper end that terminates in a latch that extends in the direction toward said shaft;

a leaf spring member mounted between said shaft and said snap action blade and generally parallel to said shaft and said blade, said leaf spring member having an upper end that includes a notch that mates with the latch on said blade;

a second contact mounted on said leaf spring member;

a button mounted at one end of said shaft, said button adapted to move said shaft in the direction of said leaf spring member and cause engagement of said first and second contacts.

2. A snap acton switch as described in claim 1 wherein said latch includes a first leg extending in the direction toward said shaft and at least one other leg extending transverse to said first leg, said first leg extending through the notch in the leaf spring member with said other leg engageable with the side of said leaf spring member facing toward said shaft.

3. A snap action switch as described in claim 1 including:

means for biasing said leaf spring member in a direction toward said shaft; and means for biasing said snap action blade in a direction away from said shaft, said means biasing said blade providing a greater biasing force than the biasing force on said leaf spring member.

4. A snap action switch as described in claim 2 including:

means for biasing said leaf spring member in a direction toward said shaft; and means for biasing said snap action blade in a direction away from said shaft, said means biasing said blade providing a greater biasing force on said leaf spring member.

5. A snap action switch comprising:

a housing having an upper end;

a shaft movably mounted within the housing;

a first contact mounted on said shaft;

a snap action blade mounted within said housing generally parallel to said shaft, said blade having an upper end that includes a notch;

a leaf spring member mounted between said shaft and said snap action blade and generally parallel to said shaft and said blade, said leaf spring member having an upper end that terminates in a latch that extends in the direction away from said shaft and mates with the notch in said blade;

a second contact mounted on said leaf spring member; and a button mounted at one end of said shaft, said button adapted to move said shaft in the direction of said leaf spring member and cause engagement of said first and second contacts.

6. A snap action switch as described in claim 5 wherein said latch includes a first leg extending in the direction away from said shaft and at least one other leg extending transverse to said first leg, said first leg extending through the notch in the blade with said other leg engageable with the side of said blade facing away from said shaft.

7. A snap action switch as described in claim 5 including:

means for biasing said leaf spring member in a direction toward said shaft; and means for biasing said snap action blade in a direction away from said shaft, said means biasing said blade providing a greater biasing force than the biasing force on said leaf spring member.

8. A snap action switch as described in claim 6 including:

means for biasing said leaf spring member in a direction toward said shaft;

means for biasing said snap action blade in a direction away from said shaft, and said means biasing said blade providing a greater biasing force than the biasing force on said leaf spring member.

9. A snap action switch comprising:

a housing having an upper end;

a shaft movably mounted within the housing;

a first contact mounted on said shaft;

a snap action member mounted within said housing generally parallel to said shaft, said member having an upper end;

a leaf spring member mounted between said shaft and said snap action member and generally parallel to said shaft and said blades, said leaf spring member having an upper end;

a second contact mounted on said leaf spring member; and a button mounted at one end of said shaft, said button adapted to move said shaft in the direction of said leaf spring member and cause engagement of said first and second contacts; and means for nonfixedly attaching said snap action member to said leaf spring member, said means comprising:

a latch on the upper end of one of said members; and a notch in the upper end of said other member that mates with said latch.

10. A snap action switch as described in claim 9 wherein said latch includes a first leg extending toward said other member, and a second leg extending transverse to said first leg, said second leg adapted to engage a portion of one side of said other member.

* * * * *